US005509964A

United States Patent [19]

Boaz

[11] Patent Number: 5,509,964

[45] Date of Patent: Apr. 23, 1996

[54] APPARATUS AND METHOD FOR APPLYING A COATING TO GLASS USING A SCREEN PRINTING PROCESS

[75] Inventor: Premakaran T. Boaz, Livonia, Mich.

[73] Assignee: Ford Motor Company, Dearborn, Mich.

[21] Appl. No.: 295,574

[22] Filed: Aug. 25, 1994

[51] Int. Cl.[6] ..... B05C 3/00; B05C 13/00

[52] U.S. Cl. ..... 118/58; 118/406; 118/413

[58] Field of Search ..... 427/282, 287, 427/377, 378; 118/58, 406, 413; 101/114, 123, 124, 126, 127.1, 128.1, 128.4, 129

[56] References Cited

U.S. PATENT DOCUMENTS

| | | | |
|---|---|---|---|
| 3,176,843 | 4/1965 | Hoskins et al. | 209/403 |
| 3,221,648 | 12/1965 | Weiss | 101/129 |
| 3,880,609 | 4/1975 | Caddock | 29/620 |
| 4,253,393 | 3/1981 | Sato | 101/35 |
| 4,568,455 | 2/1986 | Huber et al. | 209/405 |
| 4,702,165 | 10/1987 | Anderson | 101/114 |
| 5,050,498 | 9/1991 | Smith | 101/127.1 |
| 5,273,780 | 12/1993 | Borger et al. | 427/163 |

FOREIGN PATENT DOCUMENTS

| | | | |
|---|---|---|---|
| 813112 | 5/1959 | United Kingdom | 101/114 |

*Primary Examiner*—Shrive Beck
*Assistant Examiner*—Fred J. Parker
*Attorney, Agent, or Firm*—Lorraine S. Melotik; Roger L. May

[57] ABSTRACT

An apparatus and method for applying a coating to glass including a support surface for supporting a glass pane, a print screen having a screen support frame defining a perimeter of the print screen disposed above the support surface to apply a coating over the print screen. The print screen is deflected into contact with the glass pane at predetermined points thereon and the coating is moved over the print screen to deposit the coating on the predetermined points on the glass pane when the print screen is so deflected. The apparatus also includes a vapor manifold having a predetermined width disposed within the perimeter defined by the screen support frame and coupled to a source of vapor. The vapor manifold distributes a vapor blanket over the print screen and the glass pane, thereby reducing the rate at which the coating on the glass pane dries and impede evaporation of the coating from the print screen.

12 Claims, 2 Drawing Sheets

FIG 1
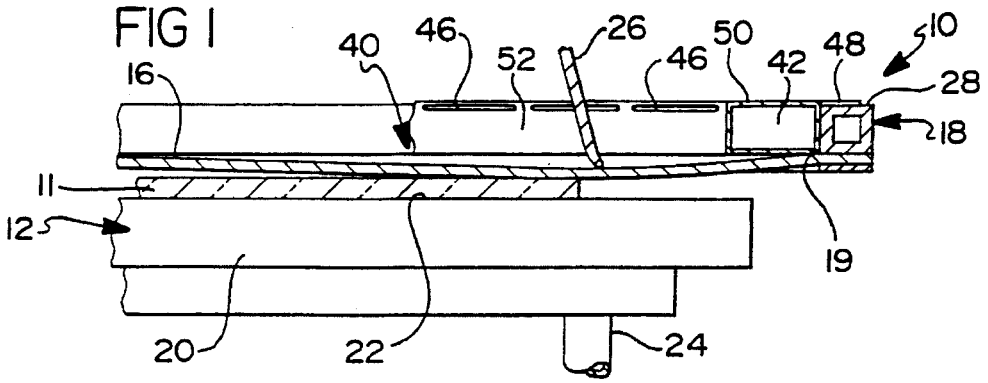
FIG 2
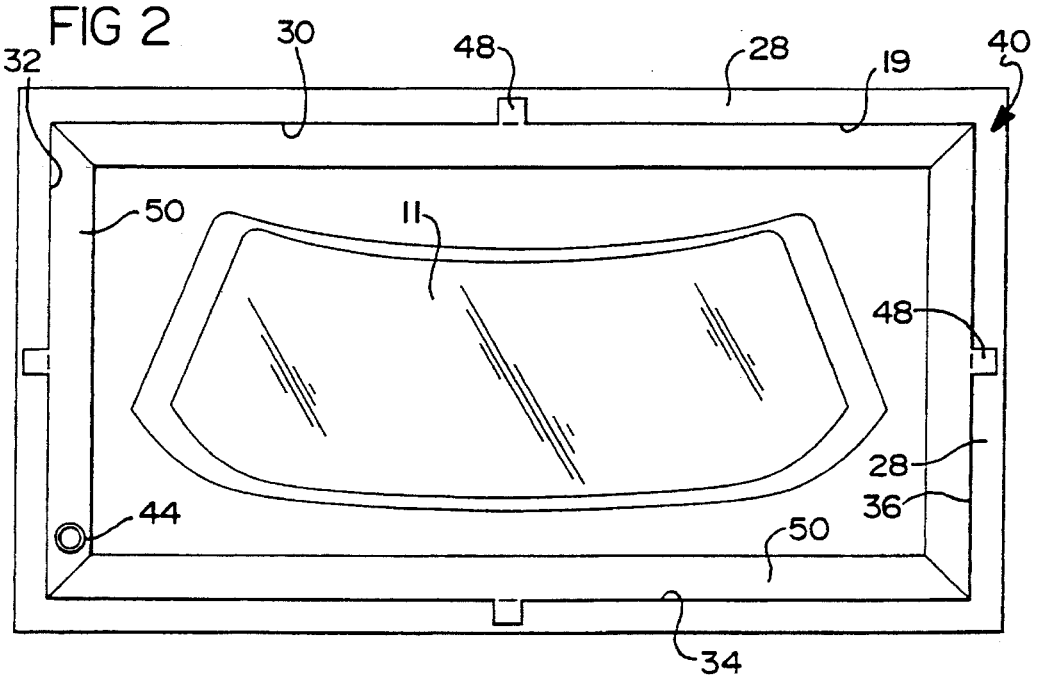
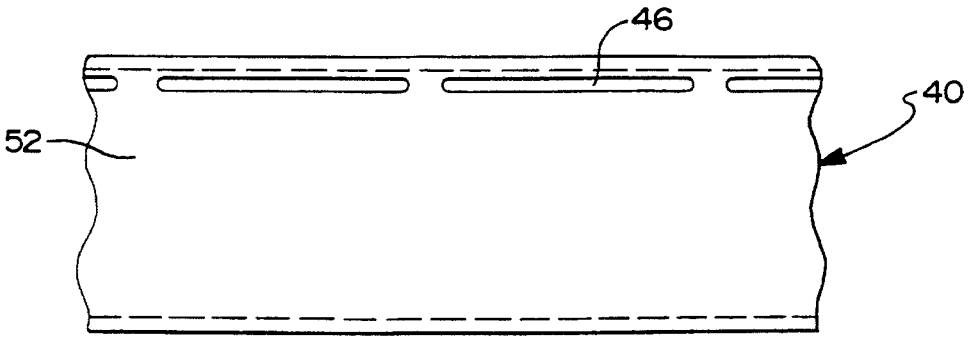
FIG 5

FIG 3
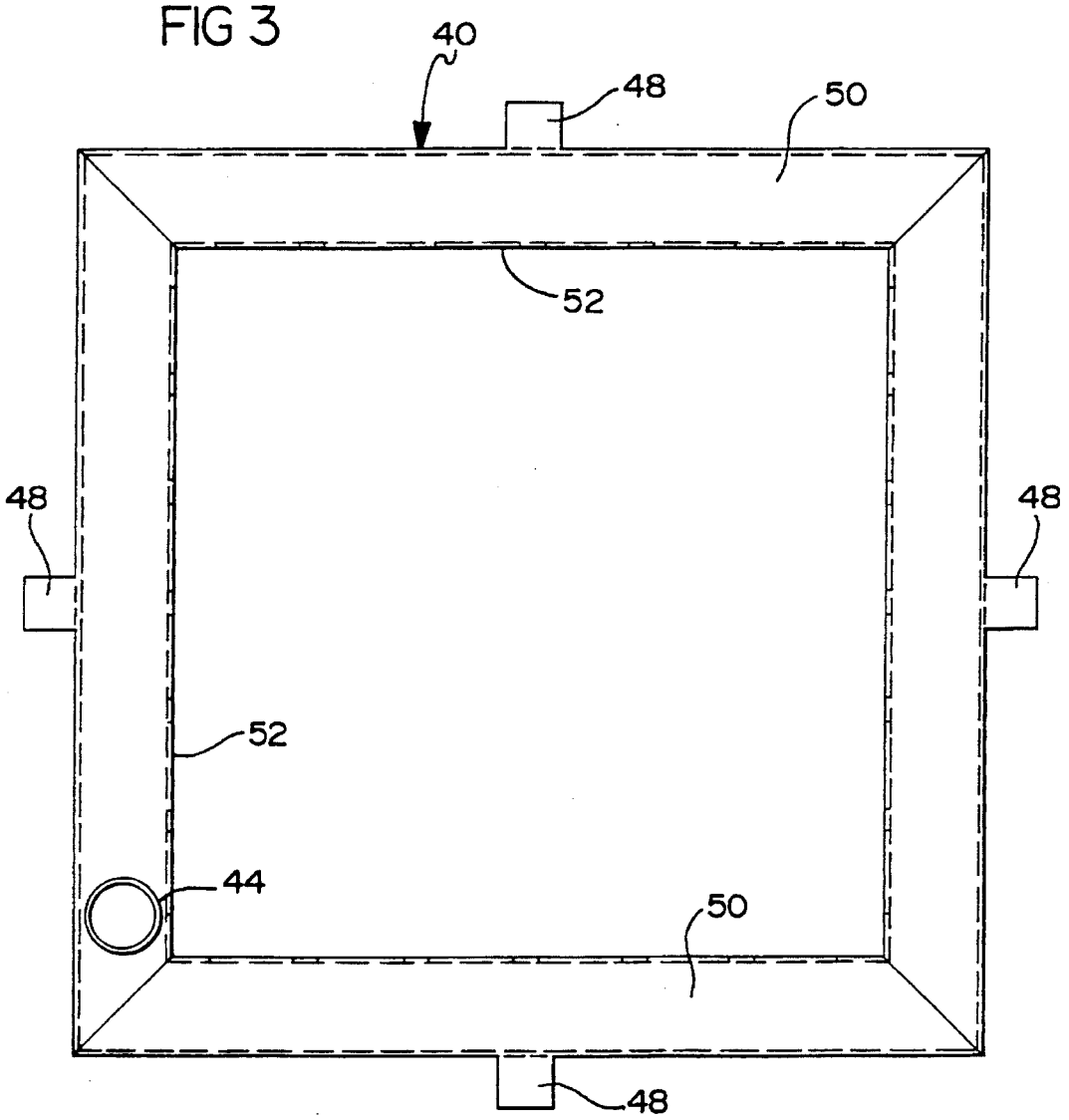
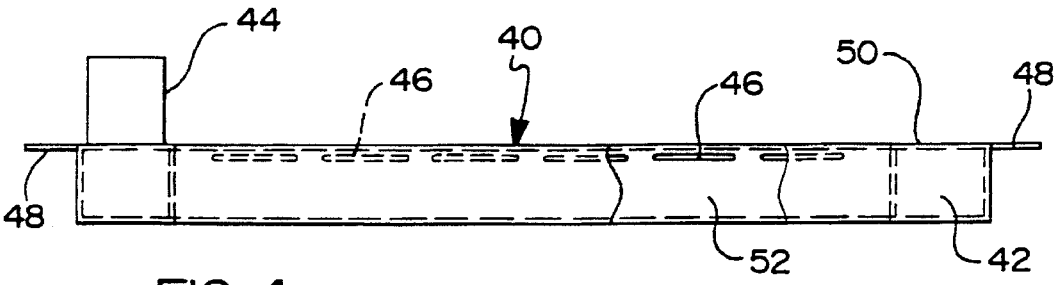
FIG 4

APPARATUS AND METHOD FOR APPLYING A COATING TO GLASS USING A SCREEN PRINTING PROCESS

BACKGROUND OF THE INVENTION

1. Field of the Invention

The present invention relates generally to coating glass and, more specifically, to an apparatus and method for applying a protective coating to a glass pane using a screen printing process.

2. Description of the Related Art

An automotive windshield is generally shatter-proof and typically manufactured by using two pieces of glass pane with a clear film laminated therebetween. When a force sufficient to break the glass panes is imparted to the windshield, the clear film holds broken glass in place as part of the whole windshield and prevents the glass panes from shattering, thereby protecting the passengers or others from the deleterious effects of flying sharp pieces of broken glass.

Typically, the windshield is bonded to the vehicle about the peripheral edges of the glass panes using an adhesive well known in the art for such purposes. However, certain disadvantages exist when the adhesive is continuously or repeatedly exposed to ultraviolet light from the sun. Ultraviolet light may cause the adhesive to degrade, losing its bonding characteristics and possibly causing the windshield to separate from the vehicle.

In order to overcome these disadvantages, it is known in the art to coat the glass panes with an ultraviolet protective coating or paste which may resemble paint or ink at the periphery of the glass panes and corresponding to the area where the adhesive is applied. This is done using conventional screen printing processes. More specifically, a glass pane is supported in an apparatus including a print screen disposed in spaced relationship over the glass and the screen is covered with an ultraviolet protective coating. The print screen is deflected into contact with the glass pane typically by squeegees. The squeegees move the protective coating across the print screen and into contact with the glass pane to deposit the protective coating in predetermined points on the glass pane. Examples of apparatuses and methods for applying a coating using screen printing processes are disclosed in U.S. Pat. No. 5,050,498 issued to Smith on Sep. 24, 1991 for a Stencil Manufacturing Process And Apparatus and U.S. Pat. No. 5,273,780 issued to Borger et al. on Dec. 28, 1993 for Screen Printing A Glass Pane With A Decorative Coating Including Blowing Away Or Sucking Printing Ink From The Edge Of The Glass Pane.

Generally, automotive windshields are manufactured in factories which can become hot due to the heat generated in the glass manufacturing process as well as the ambient temperature of the air, especially in the Summer months. In the past, when oil based ultraviolet protective coatings were typically employed, there has been a problem with evaporation of the ultraviolet protective coating due to this heat. This problem is further compounded with the move to water based ultraviolet protective coatings. High ambient temperatures can decrease curing time of the ultraviolet protective coating. Both conditions may degrade the protective feature of the ultraviolet protective coating and are undesirable.

Lowering the temperature at the ultraviolet protective coating stage of the manufacturing process through air conditioning or building a separate climate controlled area or booth have been deemed too costly. Still, the need to retard the evaporation of the ultraviolet protective coating and lengthen the curing time of the same remains.

SUMMARY OF THE INVENTION

Accordingly, the present invention is an apparatus for applying a coating to glass including a support surface for supporting a glass pane, a print screen having a screen support frame defining a perimeter of the print screen disposed above the support surface to apply a coating over the print screen. The print screen is deflected into contact with the glass pane at predetermined points thereon and the coating is moved over the print screen to deposit the coating on the predetermined points on the glass pane when the print screen is so deflected. The apparatus further includes a vapor manifold disposed within the perimeter defined by the screen support frame and coupled to a source of vapor. The vapor manifold distributes a vapor blanket over the print screen and the glass pane, thereby reducing the rate at which the coating dries and impede evaporation of the coating from the print screen.

Additionally, the present invention is a method for applying a coating to glass including the steps of supporting a glass pane on a support surface, disposing a print screen above the support surface and applying a coating over the print screen, deflecting the print screen into contact with the glass pane at predetermined points thereon and moving the coating over the print screen to deposit the coating on the predetermined points on the glass pane. The method further includes the steps of distributing a vapor blanket over the print screen and the glass pane to reduce the rate at which the coating dries and impede evaporation of the coating from the print screen.

One feature of the present invention is that an apparatus and method is provided for applying a coating to glass. Another feature of the present invention is that the apparatus and method eliminate or substantially reduce evaporation of the ultraviolet protective coating from the print screen during the manufacturing process in a cost effective, efficient manner and without the expense associated with providing an air conditioned, controlled environment at this stage of the manufacturing process.

Other features and advantages of the present invention will be readily appreciated as the same becomes better understood after reading the subsequent description when considered in connection with the accompanying drawings.

BRIEF DESCRIPTION OF THE DRAWINGS

FIG. 1 is a partial cross-sectional side view of an apparatus for applying a coating to glass, according to the present invention, illustrated in operational relationship with a glass pane.

FIG. 2 is a top view of the apparatus of FIG. 1 illustrating a screen support frame, vapor manifold and the glass pane.

FIG. 3 is a top view of a vapor manifold, according to the present invention for the apparatus of FIG. 1.

FIG. 4 is a side view of the vapor manifold of FIG. 3.

FIG. 5 is a partial cross-sectional side view of the vapor manifold of FIG. 3.

DESCRIPTION OF THE PREFERRED EMBODIMENT(S)

Referring to the drawings and in particular FIG. 1, one embodiment of an apparatus 10 for applying a coating, such as an ultraviolet protective coating, to glass such as a glass pane 11 used in a windshield for a vehicle such as an automotive vehicle (not shown). The apparatus 10 includes a support surface, generally indicated at 12, onto which the glass pane 11 may be laid and supported. The apparatus 10 also includes a print screen 16 having a screen support frame, generally indicated at 18, which defines a perimeter 19 of the print screen 16. The print screen 16 is taughtly supported by the screen support frame 18 above the support surface 12 onto which the glass pane 11 is laid. The print screen 16 is capable of deflection to contact the glass pane 11 at predetermined points thereon to apply a protective coating to the glass pane 11 when the print screen 16 is so deflected.

The protective coating is of an ultraviolet protective type and is applied to the glass pane 11 in the area corresponding to the adhesive to prevent the breakdown of the adhesive. The ultraviolet protective coating may be either oil or solvent based or water based as is commonly known in the art. The ultraviolet protective coating is applied using screen printing technology as will be described in greater detail below.

The support surface 12 may be any structure which adequately supports the glass pane 11. As illustrated in FIG. 1, the support surface 12 may be a table 20 having a top surface 22 on which the glass pane 11 is laid. The table 20 may be supported by legs 24, one of which is illustrated in FIG. 1.

The apparatus 10 further includes a squeegee 26 for causing deflection of the print screen 16 to contact the glass pane 11 at predetermined points for applying the protective coating to the glass pane 11. The squeegee 26 is moveable across the print screen 16 so as to deflect the print screen 16 into substantially line contact with the glass pane 11 and also moving the protective coating along the print screen 16 to deposit the same on the glass pane 11. It should be appreciated that any suitable means for causing deflection of the print screen 16 may be used such as a pneumatic device for creating a controlled vacuum beneath the print screen 16 to cause it to deflect into contact with the glass pane 11 or any other suitable means commonly known in the art for such purposes.

Referring to FIGS. 1 and 2, the screen support frame 18 has an upper surface 28. The screen support frame 18 is substantially rectangular in cross section and substantially rectangular in shape defining the rectangular perimeter 19 with four internal sides 30, 32, 34 and 36. While the screen support frame 18 is rectangular in the preferred embodiment, it should be appreciated that the screen support frame 18 may be of any geometric shape such as square, round, octagonal, etc., depending on the shape of the print screen 16.

Referring to FIGS. 2 through 5, the apparatus 10 further includes a vapor manifold, according to the present invention and generally indicated at 40. The vapor manifold 40 has a predetermined width disposed within the perimeter 19 defined by the screen support frame 18 and coupled to a source of vapor (not shown). The source of vapor may be a solvent or humidified air depending on the type of ultraviolet protective coating used. The vapor manifold 40 distributes a vapor blanket over the print screen 16 and glass pane 11, thereby reducing the rate at which the ultraviolet protective coating dries and preventing premature evaporation of the ultraviolet protective coating. The vapor manifold 40 has a hollow interior 42 and includes at least one inlet 44 in fluid communication with the source of vapor as well as a plurality of exit ports 46 disposed about the vapor manifold 40. The exit ports 46 are spaced from the perimeter 19 of the screen support frame 18 by the width defined by the vapor manifold 40. The vapor manifold 40 distributes the vapor from the source through the inlet 44 and the hollow interior 42 and out the exit ports 46 to create a vapor blanket over the print screen 16. In the preferred embodiment, the vapor manifold 40 closely conforms to the rectangular perimeter 19 of the screen support frame 18 and is disposed in nesting relationship within the perimeter 19 of the screen support frame 18.

The vapor manifold 40 includes stabilizing flanges 48 extending outwardly from each of the four sides of the rectangular shaped vapor manifold 40 and engaging the upper surface 28 of the screen support frame 18. The stabilizing flanges 48 support the vapor manifold 40 when the vapor manifold 40 is disposed within the perimeter 19 defined by the screen support frame 18.

The hollow interior 42 of the vapor manifold 40 is substantially rectangular in cross section. The inlet 44 is disposed on an upper top surface 50 of the vapor manifold 40 and the exit ports 46 are disposed along innermost surfaces 52 perpendicular to the uppermost top surface 50 of the vapor manifold 40. The exit ports 46 are spaced from the screen support frame 18. More specifically, the exit ports 46 are a series of elongated slots spaced along the innermost surfaces 52 of the vapor manifold 40 and extending parallel to a longitudinal axis of each innermost surface 52 and parallel to the innermost four sides 30, 32, 34 and 36 of the screen support frame 18.

The present invention is also directed toward a method of applying the ultraviolet protective coating to the glass pane 11. The method includes the steps of supporting the glass pane 11 on the support surface 12, disposing the print screen 16 above the support surface 12 and applying the protective coating over the print screen 16. The method further includes the steps of deflecting the print screen 16 into contact with the glass pane 11 at predetermined points thereon and moving the protective coating over the print screen 16 to deposit the protective coating on the predetermined points on the glass pane 11. Furthermore, the method includes the steps of distributing a vapor blanket over the print screen 16 and the glass pane 11 to reduce or retard the rate at which the protective coating dries and impede evaporation of the protective coating from the print screen 16.

Furthermore, the method of the present invention includes the steps of securing the print screen 16 to the screen support frame 18 which defines the perimeter 19 of the print screen 16 and nesting the vapor manifold 40 within the perimeter 19 defined by the screen support frame 18. The vapor manifold 40 is connected to the source of vapor such as humidified air and communicates vapor from the source over the print screen 16 and immediately adjacent the coated glass pane 11 through at least one inlet 44 and the hollow interior 42 of the vapor manifold 40 and out a plurality of exit ports 46 in the vapor manifold 40. The exit ports 46 are disposed facing the interior of the perimeter 19 defined by the screen support frame 18.

Accordingly, the apparatus 10 of the present invention employs the vapor manifold 40 to communicate vapor directly over the print screen 16 and the glass pane 14 to prevent evaporation of the ultraviolet protective coating employed to protect the adhesive used to laminate two glass panes together with a clear film therebetween to make an automotive windshield. The apparatus 10 is inexpensive, does not overly complicate the process of applying the ultraviolet protective coating to glass and avoids the added expense of adding a climate controlled work area or booth to the glass manufacturing process.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. An apparatus for applying a coating to glass, said apparatus comprising;

a support surface for supporting a glass pane;

a print screen having a screen support frame defining a perimeter of said print screen disposed above said support surface to apply a coating over said print screen, said print screen being deflected into contact with the glass pane at a plurality of points thereon and the coating being moved over said print screen to deposit the coating on the glass pane when said print screen is so deflected; and a vapor manifold disposed within the perimeter of said print screen defined by said screen support frame and coupled to a source of vapor, wherein said vapor manifold has a hollow interior and includes at least one inlet in fluid communication with the source of vapor and a plurality of exit ports disposed about said vapor manifold and spaced from the perimeter of said print screen by a width defined by said vapor manifold, said vapor manifold distributing the vapor from the source through said inlet and said hollow interior and out said exit ports to create a vapor blanket over said print screen.

2. An apparatus as set forth in claim 1 wherein said screen support frame defines an upper surface, said vapor manifold including stabilizing flanges extending outwardly and engaging said upper surface of said screen support frame and supporting said vapor manifold when said vapor manifold is disposed within said perimeter defined by said screen support frame.

3. An apparatus as set forth in claim 2 wherein said screen frame has substantially a rectangular shape defining a rectangular perimeter having four sides, said vapor manifold closely conforming to said rectangular perimeter and disposed in a nesting relationship within said perimeter of said screen support frame.

4. An apparatus as set forth in claim 3 wherein said hollow interior of said vapor manifold is substantially rectangular in cross section with said at least one inlet being disposed on the upper top surface of said vapor manifold and said exit ports being disposed along the inner most surfaces parallel to said upper most top surface of said vapor manifold and spaced from said screen support frame.

5. An apparatus as set forth in claim 4 wherein said plurality of exit ports are a series of elongated slots disposed on the inner most surfaces of said vapor manifold spaced from said print screen and extending parallel to a longitudinal axis of each of said inner most surfaces and parallel to said four sides of said screen support frame.

6. An apparatus as set forth in claim 1 including means for causing deflection of said print screen to contact the glass pane at a plurality of points for applying the coating to the glass pane.

7. An apparatus as set forth in claim 6 wherein said means for causing deflection comprises a squeegee movable across said print screen so as to deflect said print screen into substantially line contact with the glass pane and move the coating along said print screen to deposit the coating on the glass pane.

8. An apparatus for applying a protective coating to a glass pane, said apparatus comprising:

a support surface for supporting a glass pane;

a print screen having a screen support frame defining a perimeter of said print screen and tautly supporting said print screen above said support surface;

a squeegee movable across said print screen so as to deflect said print screen into substantially line contact with the glass pane and move a protective coating along said print screen to deposit the protective coating at a plurality of points on the glass pane; and a vapor manifold closely conforming to the perimeter of said print screen and disposed in nesting relationship with said screen support frame, said vapor manifold having a hollow interior and including at least one inlet in fluid communication with a source of humidified air and a plurality of exit ports disposed about said print screen and spaced from the perimeter of said print screen by a width defined by said vapor manifold, said vapor manifold distributing humidified air from the source through said vapor manifold and said hollow interior and out said exit ports to create a vapor blanket over said print screen.

9. An apparatus as set forth in claim 8 wherein said screen support frame defines an upper surface, said vapor manifold including stabilizing flanges extending outwardly and engaging said upper surface of said screen support frame and supporting said vapor manifold when said vapor manifold is disposed within said perimeter defined by said screen support frame.

10. An apparatus as set forth in claim 9 wherein said screen support frame has a substantially rectangular shape defining a rectangular perimeter having four sides, said vapor manifold closely conforming to said perimeter and disposed in a nesting relationship within said perimeter of said screen support frame.

11. An apparatus as set forth in claim 10 wherein said hollow interior of said vapor manifold is substantially rectangular in cross section with said at least one inlet being disposed on the upper top surface of said vapor manifold and said exit ports being disposed along the inner most surfaces perpendicular to said upper most top surface of said vapor manifold and spaced from said screen support frame.

12. An apparatus as set forth in claim 11 wherein said exit ports are a series of elongated slots disposed on the inner most surfaces of said vapor manifold spaced from said print screen and extending parallel to a longitudinal axis of each said inner most surfaces and parallel to said four sides of said screen support frame.

* * * * *